US010466026B1

(12) United States Patent
Nair

(10) Patent No.: US 10,466,026 B1
(45) Date of Patent: Nov. 5, 2019

(54) AUTO LOGGING OF ELECTRONIC DETONATORS USING "SMART" INSULATION DISPLACEMENT CONNECTORS

(71) Applicant: UTEC Corporation, LLC, Riverton, KS (US)

(72) Inventor: Nanda Kumar J. Nair, Hyderabad (IN)

(73) Assignee: Utec Corporation LLC, Riverton, KS (US)

( * ) Notice: Subject to any disclaimer, the term of this patent is extended or adjusted under 35 U.S.C. 154(b) by 0 days.

(21) Appl. No.: 16/045,052

(22) Filed: Jul. 25, 2018

(51) Int. Cl.

| | |
|---|---|
| ***F42D 1/055*** | (2006.01) |
| ***F42D 5/00*** | (2006.01) |
| ***F42B 3/12*** | (2006.01) |
| ***F42C 11/06*** | (2006.01) |

(52) U.S. Cl.
CPC ..... *F42D 1/055* (2013.01); *F42B 3/121* (2013.01); *F42C 11/06* (2013.01); *F42D 5/00* (2013.01)

(58) Field of Classification Search
CPC .. F42B 3/12; F42B 3/121; F42B 3/122; F42B 3/26; F42C 11/001; F42C 11/002; F42C 11/06; F42C 15/40; F42C 15/42; F42C 15/44; F42D 1/042; F42D 1/043; F42D 1/05; F42D 1/055; F42D 1/06; F42D 5/00; F42D 5/04
USPC ..... 102/217
See application file for complete search history.

(56) References Cited

U.S. PATENT DOCUMENTS 4,489,655 A 12/1984 Molnar
4,527,636 A 7/1985 Bordon
4,718,954 A 1/1988 Machacek et al.
4,770,097 A * 9/1988 Wilson ..... F42D 1/055 102/202.13
4,771,694 A * 9/1988 Bartholomew ..... C06C 5/06 102/275.12

(Continued)

FOREIGN PATENT DOCUMENTS

WO WO2005005915 A2 1/2005
WO WO2005008169 A2 1/2005

(Continued)

OTHER PUBLICATIONS

European Patent Office, International Search Report (including search strategy) and Written Opinion, PCT Application No. PCT/US2017/017183, international patent application corresponding to the above-referenced US application, completed Apr. 20, 2017, dated May 2, 2017 (EPO, Rijswijk, NL).

*Primary Examiner* — Bret Hayes
*Assistant Examiner* — Benjamin S Gomberg
(74) *Attorney, Agent, or Firm* — Mary M. Lee

(57) ABSTRACT

A "smart" insulation displacement connector for use in a blasting system with a blast machine and conventional electronic delay detonators. A control circuit in the IDC allows conventional detonators to be logged remotely by the blast machine. Elimination of manual logging by individuals increases safety in the blast zone and facilitates the blasting operation. Additionally, the detonators are powered on sequentially in a "domino effect," which reduces the likelihood of a high surge current from the blasting machine that may occur when a large number of detonators are energized simultaneously. The logging operation is simplified, likelihood of human error is reduced, and the cost of a separate logger device is eliminated.

10 Claims, 8 Drawing Sheets

(56) References Cited

U.S. PATENT DOCUMENTS

| | | | | |
|---|---|---|---|---|
| 4,821,645 | A * | 4/1989 | Reiss | F42D 1/043 102/275.12 |
| 4,825,765 | A | 5/1989 | Ochi et al. | |
| 4,848,232 | A | 7/1989 | Kurokawa et al. | |
| 4,860,653 | A | 8/1989 | Abouav | |
| 4,869,171 | A | 9/1989 | Abouav | |
| 4,986,183 | A | 1/1991 | Jacob et al. | |
| 5,042,594 | A | 8/1991 | Gonzalez et al. | |
| 5,044,964 | A | 9/1991 | Minerd et al. | |
| 5,064,382 | A | 11/1991 | Minnis | |
| 5,189,246 | A * | 2/1993 | Marsh | F42D 1/055 102/202.1 |
| 5,338,220 | A * | 8/1994 | Soes | H01R 4/2433 439/403 |
| 5,415,556 | A | 5/1995 | Schroll | |
| 5,460,093 | A | 10/1995 | Prinz et al. | |
| 5,536,897 | A | 7/1996 | Clark et al. | |
| 5,608,184 | A | 3/1997 | Machacek et al. | |
| 5,612,507 | A | 3/1997 | Clark et al. | |
| 5,763,816 | A | 6/1998 | Keeling | |
| 5,929,368 | A | 7/1999 | Ewick et al. | |
| 6,214,140 | B1 | 4/2001 | Machacek et al. | |
| 6,283,227 | B1 | 9/2001 | Lerche et al. | |
| 6,564,686 | B1 | 5/2003 | Keeling et al. | |
| 6,644,202 | B1 | 11/2003 | Duniam et al. | |
| 6,722,251 | B2 | 4/2004 | Keeling et al. | |
| 7,054,131 | B1 | 5/2006 | Kanth et al. | |
| 7,258,054 | B1 | 8/2007 | Keeling et al. | |
| 7,530,311 | B2 | 5/2009 | Koekemoer et al. | |
| 7,604,498 | B2 | 10/2009 | Mahajan | |
| 7,617,775 | B2 | 11/2009 | Teowee | |
| 7,694,627 | B2 | 4/2010 | Koekemoer et al. | |
| 7,922,541 | B2 * | 4/2011 | Maenhout | H01R 4/2433 439/625 |
| 7,946,227 | B2 | 5/2011 | Koekemoer et al. | |
| 7,975,612 | B2 | 7/2011 | Toewee et al. | |
| 8,390,979 | B2 | 3/2013 | Hurley et al. | |
| 8,582,275 | B2 | 11/2013 | Yan et al. | |
| 8,646,387 | B2 * | 2/2014 | Schlenter | F42D 1/055 102/200 |
| 8,746,144 | B2 | 6/2014 | Givens et al. | |
| 9,157,719 | B2 | 10/2015 | Schlenter | |
| 9,250,051 | B1 | 2/2016 | Smith et al. | |
| 9,759,538 | B2 | 9/2017 | Nair | |
| 9,915,514 | B1 | 3/2018 | Nair | |
| 9,915,515 | B1 | 3/2018 | Nair | |
| 2006/0130693 | A1 | 6/2006 | Teowee | |
| 2007/0249204 | A1 | 10/2007 | Petersen et al. | |
| 2017/0234667 | A1 | 8/2017 | Nair | |

FOREIGN PATENT DOCUMENTS

| | | | |
|---|---|---|---|
| WO | WO2005090895 | A1 | 9/2005 |
| WO | WO2007118707 | A2 | 10/2007 |
| WO | WO2017139465 | A1 | 8/2017 |

* cited by examiner

AUTO LOGGING OF ELECTRONIC DETONATORS USING "SMART" INSULATION DISPLACEMENT CONNECTORS

FIELD OF INVENTION

The present invention relates generally to electronic detonators and more particularly, but without limitation, to devices and methods for logging electronic detonators.

DETAILED DESCRIPTION OF THE PREFERRED EMBODIMENTS

Figure 1:
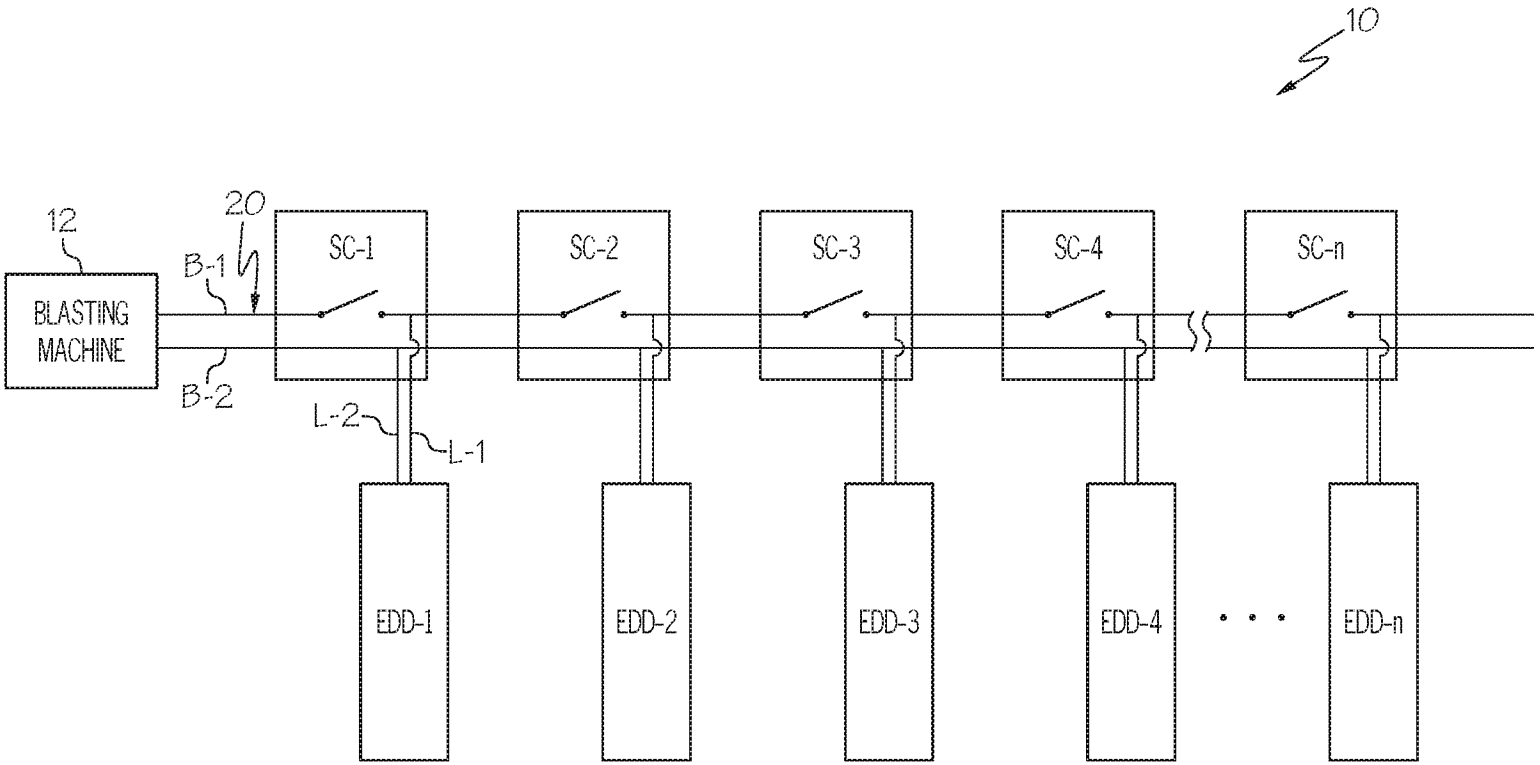
FIG. 1 is a field connection diagram for a blast system comprising a plurality of electronic delay detonators (EDD's) each of which is interconnected to the bus wires from a blast machine by an insulation displacement connector (IDC).

Electronic delay detonators ("EDD's") are excellent initiation systems for controlled blasting especially in mining operations. Advantages of electronic detonators are precise timing resulting in reduced vibrations, improved protection from stray electrical currents and radio frequencies and, to an extent, reduction in misfires through precise circuit testing. Many types of electronic detonators are commercially available. Each manufacturer has different modes of operation for each model, which result in the similar functioning on the field.

Irrespective of the various designs and modes of operations of the electronic detonators in the market today, certain procedures usually are carried out while executing a blast operation. Individual detonators are tested, and the boreholes are charged. All the detonators are logged, and the identity of each detonator and its position in the blast pattern are recorded. The blast machine uses this identity to communicate with individual detonators to test, transfer delay data, and to fire the detonators.

The typical blast procedure also includes setting the delay time of each individual detonator according to the blast design. The delay time is transferred or programmed into the detonator either during the logging operation or by the blast machine during the blast procedure.

All the detonators are connected to the main line, and line testing is conducted to confirm that all detonators are detected in the circuit. Each individual detonator is addressed using its specific identity.

In all cases, logging of the detonators on the field is mandatory to record the identity of each of the detonators with the blast hole. Typically, this is carried out either by physically connecting the detonator to the logging machine or by scanning the printed code on the detonator using an optical scanner.

Conventionally, logging is done on the charged holes while the operator stands over it. This is a safety hazard, especially when the logging is done using a physical connection of the detonator; this is because the detonator is powered, even though a safe voltage is being used for logging. In the case of the optical scanning systems, a connected logging will be required if the label on the detonator is damaged. Regardless of the method of identification employed, most current systems require an operator or "blaster" to physically visit each blast hole and perform some operation in order to carry out the procedure. This process is time consuming and inconvenient and often requires additional personnel in the field.

The present invention is directed to an insulation displacement connector (IDC) with an auto-logging feature. The IDC comprises an electronic logic control circuit to execute the automatic logging of the detonators sequentially. This "smart" IDC allows conventional EDD's to be logged remotely and automatically by the blast machine after the EDD's are placed and interconnected with the bus wires from the blast machine to form the blast circuit. The remote and automated logging process of this invention is carried out by communications between the blast machine and the detonators through the IDC's and eliminates the manual logging operation on the field.

The present invention provides a blasting system in which automated, remote and sequential logging replaces the on-the-field logging of the detonators. This increases the safety of the on-field personnel and also reduces the time required for the overall set up process. The logic circuit combined with the internal wiring in each IDC cause the chain of detonators to be energized and logged sequentially in a so-called domino effect. The sequential activation of the EDD's reduces the likelihood of a high surge current from the blasting machine, which may occur when a large number of detonators are powered on simultaneously as in conventional blasting systems. These and other features and advantages will become apparent from the following description with reference to the accompanying drawings.

Turning now to the drawings in general and to FIG. 1 in particular, there is shown therein an illustrative blast system 10. The blast system 10 comprises a blast machine 12 and first and second bus wires B-1 and B-2 that are connectable to the blast machine to form a blast circuit 20. The system 10 further comprises a plurality of electronic delay detonators, or N number of EDD's, such as EDD-1, EDD-2, EDD-3, EDD-4 to EDD-n connected in a serial blast pattern. While five EDD's are shown, the blast system 10 may include a larger or smaller number of detonators. The EDD's may be conventional EDD's of any brand or model.

Each of the EDD's, EDD-1, EDD-2, EDD-3, EDD-4 to EDD-n, is connected to the first and second bus wires B-1 and B-2 by using a "smart" insulation displacement connector (IDC) SM-1, SM-2, SM-3, SM-4 to SM-n made in accordance with the present invention. More specifically, the smart IDC's SC-1, SC-2, SC-3, SC-4 to SC-n are attached to the bus wires B-1 and B-2, and the leg wires of each EDD, such as the leg wires L-2 and L-2 called out only on EDD-1, are connected to the smart IDC's.

As illustrated in the exemplary blasting system 10 in FIG. 1, the EDD's, EDD-1, EDD-2, EDD-3, EDD-4 to EDD-n, are connected in a series in the blast circuit 20, as indicated by the numbers 1, 2, 3, and 4. This series arrangement of the detonators in the blast circuit 20 is exemplary only; various other patterns (serial, parallel, etc.) and combinations of such patterns may be employed, as is commonly understood by those skilled in the art.

Figure 2:
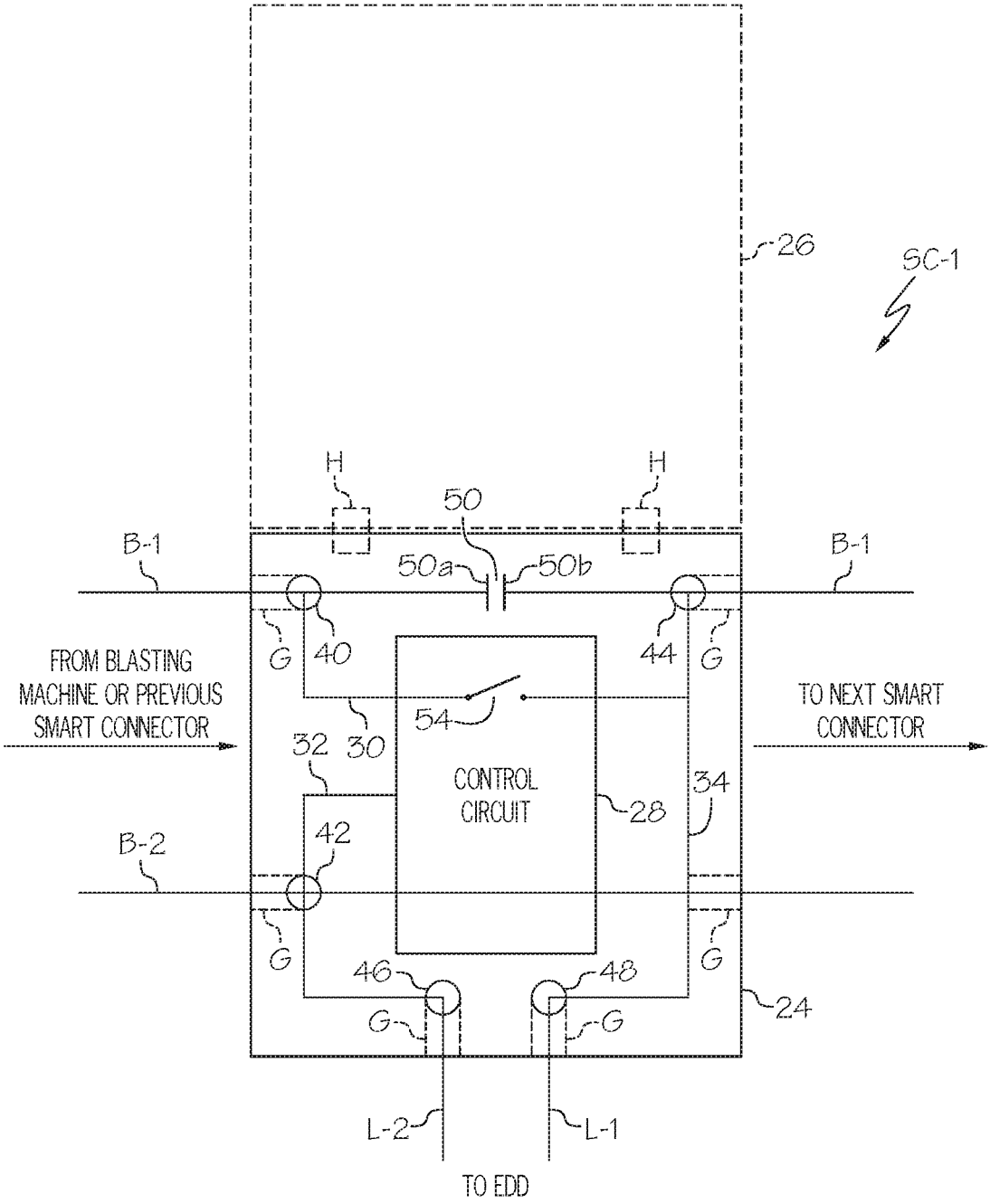
FIG. 2 is a schematic illustration of an IDC made in accordance with an embodiment of the present invention.

Referring now to FIG. 2, a preferred construction for the smart IDC's will be described. Since all the smart IDC's may be similarly made, only smart connector SC-1 will be shown and described in detail. The IDC SC-1 comprises an enclosure or casing 24. Though not shown in detail, the casing 24 preferably will be formed of non-conductive material and most preferably will be waterproof. The casing 24 may include a cover 26 that is openable, as with hinges "H," to access the structures inside.

The IDC SC-1 includes conductive elements, referred to herein as "barbs," configured to pierce the protective sheath on the bus wires and leg wires in order to establish an electrically conductive connection between the wires without severing the wires. The IDC SC-1 may include guides "G" to secure the wires in the correct position relative to the barbs. As used herein, "guide" denotes any structure that services to position the conductor or wire in the casing. Thus, "guide" includes a channel, groove, clip, bracket, recess, snap ring, cradle, or other such structure, and the guide may be a continuous or discontinuous structure.

Also included in the IDC SM-1 is a control circuit 28, explained more fully below. The IDC may include electrical connectors, such as a first connector 30, a second connector 32, and a third connector 34, to connect the leg wires and bus wires to the control circuit 28.

The IDC SC-1 includes a first barb set 40 in the casing 24 for electrically connecting the first bus wire B-1 with the first connector 30. A second barb set 42 is structured to electrically connect the second bus wire B-2 with the second connector 32. A third barb set 44 electrically connects the first bus wire B-1 to the third connector 34. The third barb set 44 is spaced a distance from the first barb set 40. A fourth barb set 46 in the casing 24 electrically connects the second leg wire L-2 of the EDD with second connector 32. A fifth barb set 48 electrically connects the first leg wire L-1 of the selected EDD with the third connector 34.

Positioned between the first and third barb sets 40 and 44 is a wire cutter 50 configured to electrically sever first bus wire B-1. The wire cutter 50 may comprises a pair of blades 50*a* and 50*b*. Now it will be understood that when the casing 24 is closed and the barb sets 40 and 44 engage the first bus wire B-1, the wire cutter 50 will completely sever the bus wire B-1.

Illustrated schematically in FIG. 2, the IDC includes a switch 54 interposed between the first and third connectors 30 and 34. The default position of the switch 54 is open, as shown. When the casing 24 is closed and the first bus wire B-1 is cut between barb sets 40 and 44, an alternative electrical path for the first bus wire is established through the switch 54 and the first and third connectors 30 and 34 when the switch 54 is closed. When the blast circuit 20 is energized and the switch 54 closes, the signal from the first bus wire B-1 will be directed both to the downstream segment of the first bus wire B-la and to the first leg wire L-1 of the EDD. The switch may be electronic, such as a semiconductor switch, or electromechanical, such as a reed switch The control circuit 28 may be a microcontroller or programmable logic device and more preferably comprises an application-specific integrated circuit chip (ASIC). The control circuit 28 is programmed to communicate with the blast machine and relay blast data from the blast machine to the EDD. The control circuit 28 is programmed, when the blast system 10 is assembled and the blast circuit 20 is energized, to receive "connector set" commands and "detonator set" commands from the blast machine 12 via the first and second bus wires B-1 and B-2. In response to an initial "connector set" command, the control circuit 28 changes the status of the IDC to "set" and closes the switch 54. In response to "detonator set" commands, the control circuit is nonresponsive. Once set, the control circuit 28 is nonresponsive to subsequent "connector set" commands.

Assembly of the blast system 10 may begin by attaching the smart IDC's SC-1 to SC-n to each of the EDD's as previously described. Next, the IDC's SC-1 to SC-n are connected to the bus wires B-1 and B-2.

When both bus wires and both leg wires are connected to the IDC, an electrical path between the first and second bus wires B-1 and B-2 is established through the control circuit of SC-1 by means of the first and second connectors 30 and 32. In this way, when the field circuit is powered on, only the first IDC is initially energized. This is because, when the first bus wire B-1 in SC-1 has been severed. Also, the first leg wire L-1 of the EDD is electrically connected to the third connector wire 34, downstream of the open switch, so neither the next IDC in line, such as SC-2, nor EDD-1 is energized until the switch 54 is closed.

When the field circuit is first powered on, and the control circuit in SC-1 is energized, the logic closes the switch 54, which energizes both EDD-1 and the next IDC in the sequence, namely, SC-2. After connecting all the EDD's according to the prescribed blast pattern and prior to energizing the blast circuit, the operator records the number and location of each of the EDD's EDD-1 to EDD-n, and this information is input into the blast machine, and the blast machine controls the connection sequence.

Once the blast system 10 is fully assembled in the field, and the number and position of each of the EDD's is input into the blast machine, the logging operation may be commenced. A first "talk back" embodiment of the auto-logging operation is summarized in the logic diagrams of FIGS. 3A-3C, to which attention now is directed.

Figure 3A:
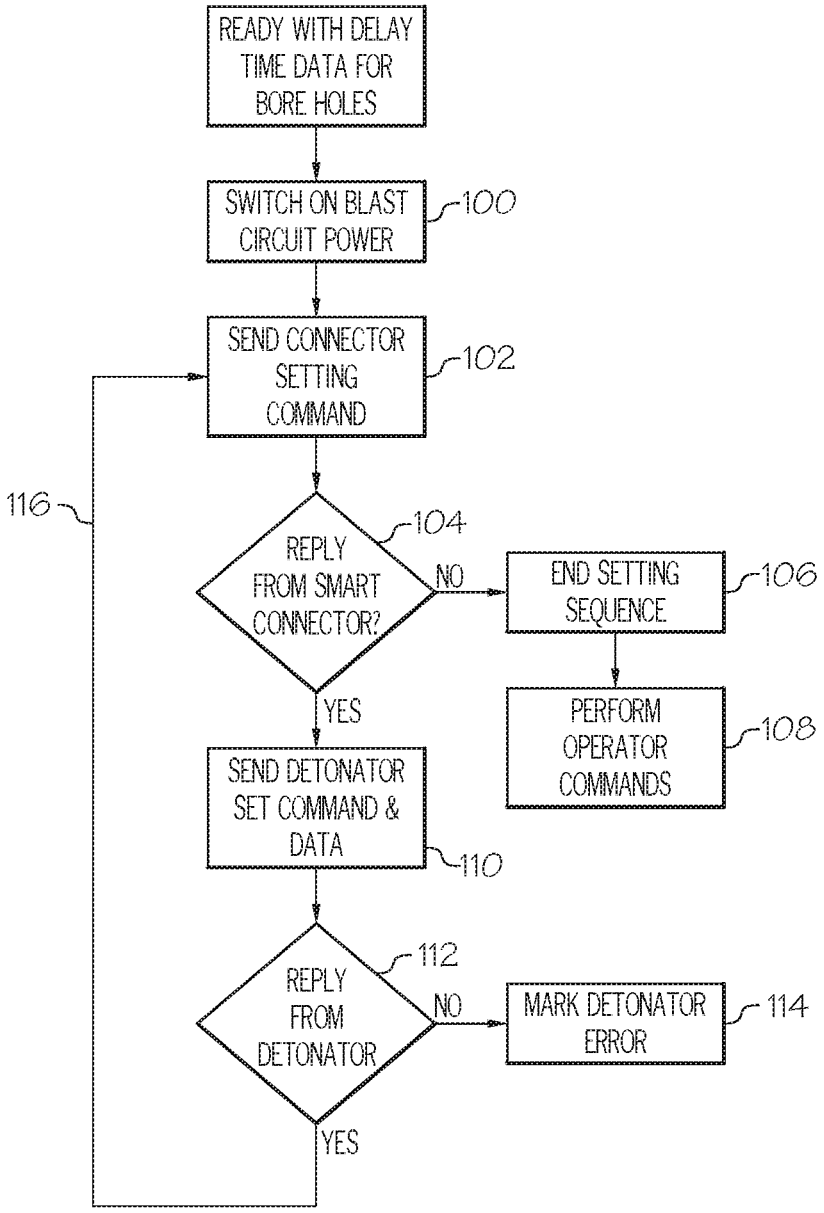
FIG. 3A shows a functional flow diagram illustrating the logic carried out by the blast machine in an auto-logging operation using a first embodiment of the IDC that is programmed to "talk back" to the blast machine.

The blast machine is loaded with the detonator position and delay data and is powered on at 100 in FIG. 3A. At block 102, the blast machine sends a "connector set" command and at block 104 waits for a reply signal from the first IDC SC-1 (FIG. 1) that the IDC has been set successfully. On receipt of a first "connector set" command, the IDC marks itself as set and closes the switch, which powers up the EDD, namely, EDD-1. The EDD will not respond to the "connector set" command, as it is programmed to respond only to "detonator" commands. If no confirmation signal is received from the IDC, the setting sequence is terminated at 106 and the blaster enters appropriate commands at 108.

If the blast machine receives the "connector setting confirmed" reply signal from the SC-1 at block 104, the blast machine sends a "detonator set" command and the appropriate detonator data for EDD-1 to that detonator at block 110. This signal is transmitted to the EDD through bus wire B-1 and the first and third connectors 30 and 34 in the IDC as both SC-1 and EDD-1 now are energized. The EDD's are programmed to respond to a "detonator set" command with a signal confirming successful receipt of a "detonator set" command and the detonator data. Upon receipt of a "setting confirmation" from EDD-1, the blast machine repeats the cycle at 116 by sending another "connector set" command at block 102. If no "setting confirmation" is received from the EDD, the blast machine records a "detonator error" at block 114 and terminates the logging operation.

When the switch in SC-1 is closed, the next IDC in the sequence, namely, SC-2 (FIG. 1) is also powered on via bus wire B-1*a*. The control circuits in the IDC's are programmed to respond only to "connector" commands, so SC-2 does not respond to the "detonator set" commend sent to EDD-1. But when the blast machine sends the next "connector set" command, SC-2 responds to it with a confirmation signal. This process continues from IDC to IDC in the "relay" sequence until the blast machine receives no feedback from a "connector set" command, indicating that the logging operation is completed.

Figure 3B:
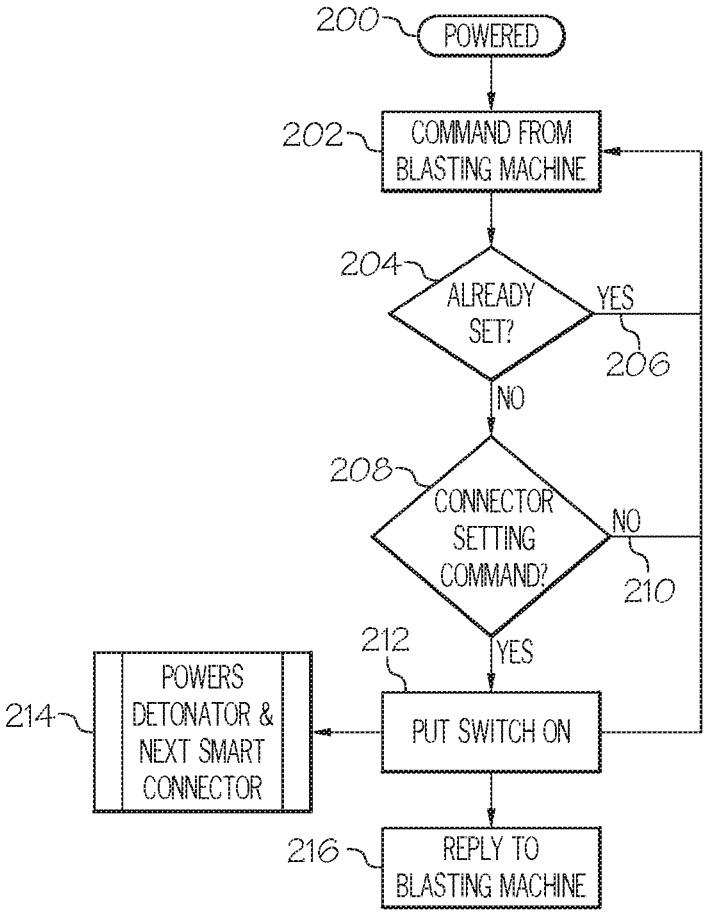
FIG. 3B is a functional flow diagram illustrating the logic carried out by the control circuit in the IDC shown in FIG. 2 and operating according to the first embodiment.

FIG. 3B shows the logic diagram for the IDC. At 200, the IDC is powered on when the blast machine energizes the blast circuit because the first and second connectors 30 and 32 (FIG. 2) connect the first bus wire B-1 with the second bus wire B-2. Since the first bus wire B-1 is severed by the wire cutter 50, downstream IDC's are not powered. In response to a command from the blast machine at block 202, the IDC responds depending on whether it is already marked as "set" or not. IF the IDC is already set, it ignores the command.

If the IDC is not already set, it responds at block 208 only if the command is a "connector set" command. The IDC is non-responsive to a "detonator set" command as indicated at 210. In response to a "connector set" command, the control circuit closes the switch at block 212, re-establishing continuity of the first bus wire B-1. As indicated at block 214, when the switch is closed, the EDD and the next IDC in the sequence are energized. As indicated at block 216, a "connector setting confirmed" reply signal confirming successful setting of the IDC is sent back to the blast machine.

Figure 3C:
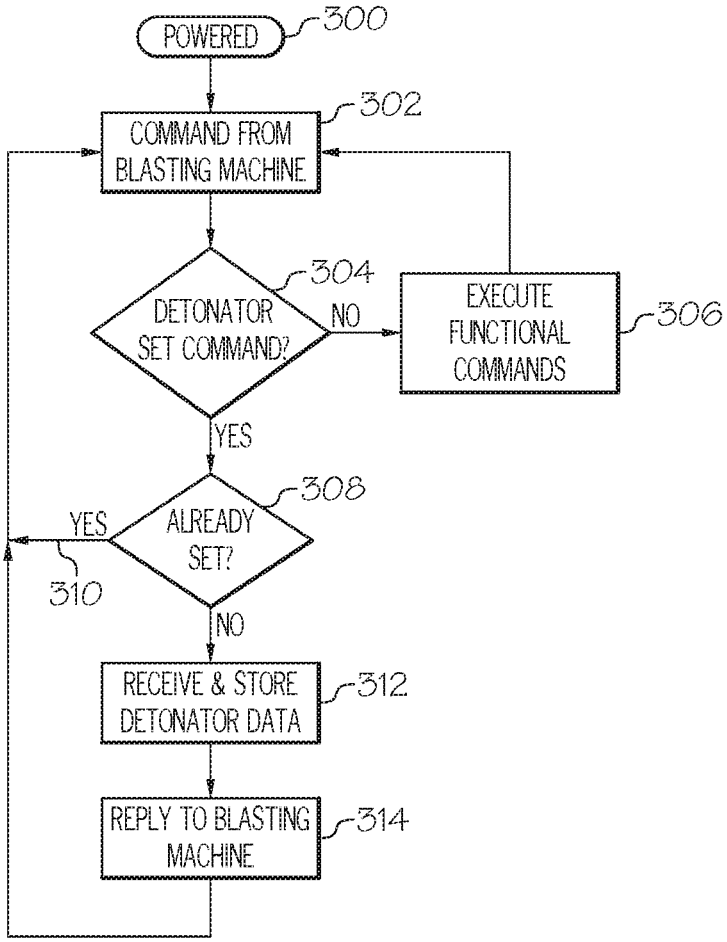
FIG. 3C is a functional flow diagram illustrating the logic carried out by the EDD in cooperation with the IDC operating as shown in FIG. 3B.

FIG. 3C shows the logic diagram for the EDD. At 300, the EDD is powered on when the IDC is energized. At 302, the EDD control circuit waits for a signal from the blast machine. The EDD is non-responsive to a "connector" signal. If the signal is other than a "detonator" or "connector" signal, the EDD responds according to the command to execute other functions at block 306. By way of example, these other functions may include diagnostics, sending data to or receiving data from the blast machine, and performing timing and firing actions.

The EDD responds at block 308 depending on whether it is already marked as "set" or not. IF the EDD is already set, it ignores the command and loops to 302 for further commands. If the EDD is not set, it accepts and stores the detonator data at 312 and replies to the blast machine at 314 successful completion of the detonator setting function.

Now it will be appreciated that in the embodiment of FIGS. 3A-3C there is two-way communication between the smart ICD and the blast machine. Specifically, the IDC sends a signal back to the blast machine confirming connection of the EDD. This allows the blast machine to know if a specific detonator is connected.

In accordance with another embodiment of the present invention, the smart IDC eliminates the two-way communication with the blast machine. This "leaner" version offers lower cost and a smaller circuit size. However, when the blast machine receives no response from a detonator during the logging process, the blaster will not know if the failure is in the IDC or the detonator or in some other connection. The operation of this second embodiment is illustrated in FIGS. 4A-4C.

Figure 4A:
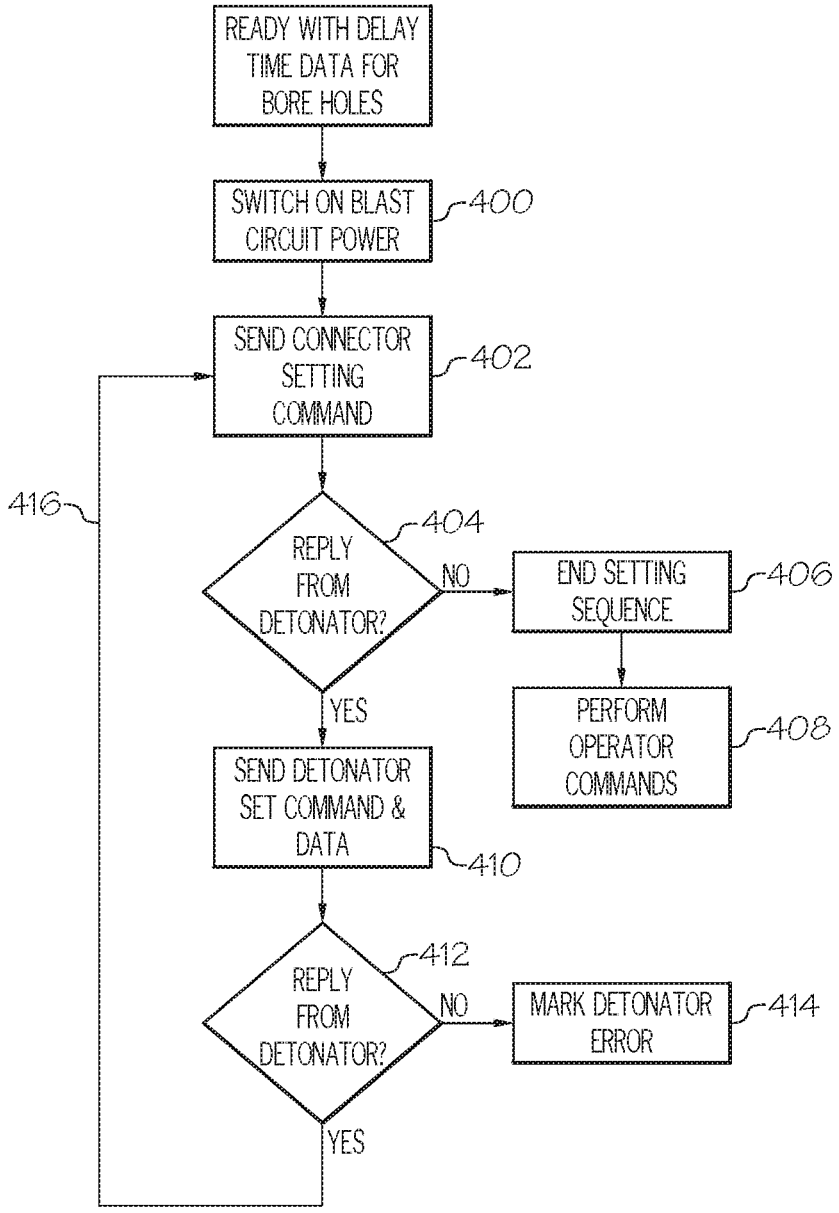
FIG. 4A shows a functional flow diagram illustrating the logic carried out by the blast machine in an auto-logging operation using a second embodiment of the IDC that is programmed without the "talk back" feature of the first embodiment.
Figure 4B:
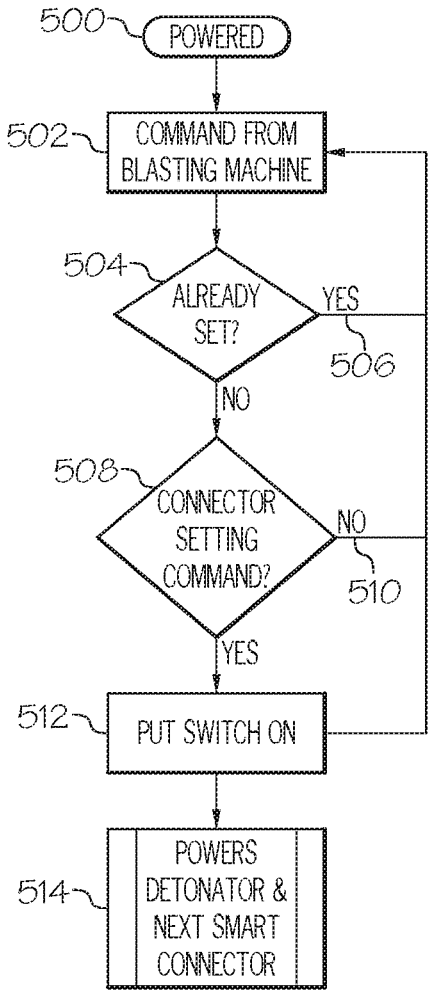
FIG. 4B is a functional flow diagram illustrating the logic carried out by the control circuit in the IDC shown in FIG. 2 and operating according to the second embodiment.
Figure 4C:
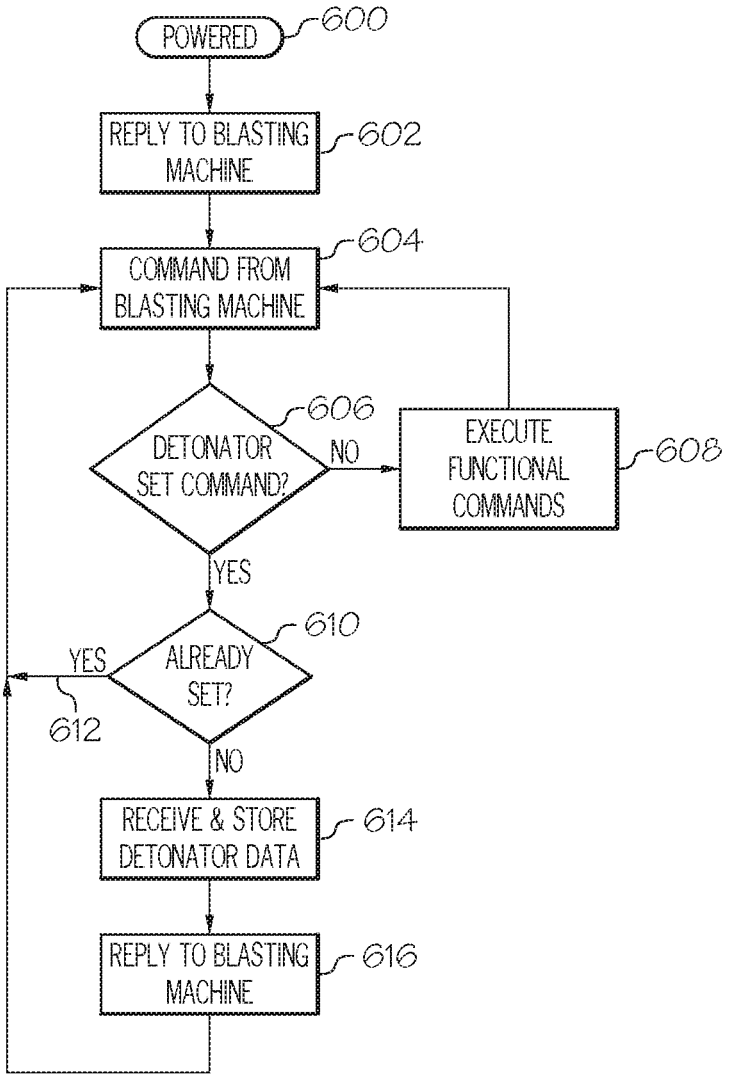
FIG. 4C is a functional flow diagram illustrating the logic carried out by the EDD in cooperation with the IDC operating as shown in FIG. 4B.

The blast machine is loaded with the detonator position and delay data and is powered on at 400 in FIG. 4A. At block 402, the blast machine sends a "connector set" command. At block 404, the blast machine waits for a reply signal from the first EDD, namely, EDD-1 (FIG. 1) that the first IDC, namely, SC-1, has been set successfully and confirming that the connection to the EDD through the IDC has been established. The EDD will not respond to the "connector set" command, as it is programmed to respond only to "detonator" commands. If no confirmation signal is received from the EDD, the setting sequence is terminated by the blast machine at 406 and the blaster enters appropriate commands at 408.

If the blast machine receives the "IDC setting confirmed" reply signal from the EDD-1 at block 404, the blast machine sends a "detonator set" command and the appropriate detonator data for EDD-1 to that detonator at block 410. This signal is transmitted to the EDD through the first bus wire B-1 (using the alternative path created by the switch), as both SC-1 and EDD-1 now are energized. The EDD's are programmed to respond to a "detonator set" command with a signal confirming successfully receipt of a "detonator set" command and the detonator data. At block 412, upon receipt of an "EDD setting confirmation" reply from EDD-1, the blast machine repeats the cycle at 416 by sending another "connector set" command at block 402. If no "EDD setting confirmation" reply is received from the EDD at 412, the blast machine records a "detonator error" at block 414 and terminates the logging operation.

When the switch in the SC-1 is closed, the next IDC in the sequence, namely, SC-2 (FIG. 1) is also powered on. The control circuits in the IDC's are programmed to respond only to "connector" commands, so SC-2 does not respond to the "detonator set" commend send to EDD-1. But when the blast machine sends the next "connector set" command, SC-2 responds to it with a confirmation signal. This process continues from IDC to IDC is the sequence until the blast machine receives no feedback from a "connector set" command indicating that the logging operation is completed.

FIG. 4B shows the logic diagram for the IDC. At 500, the IDC is powered on when the blast machine energizes the blast circuit. In response to a command from the blast machine at block 502, the IDC responds depending on whether it is already marked as "set" or not. IF the IDC is already set, it ignores the command.

If the IDC is not already set, it responds at block 508 only if the command is a "connector set" command. The IDC is non-responsive to a "detonator set" command, as indicated at 510. In response to a "connector set" command, the control circuit closes the switch at block 512, establishing the alternative path of the first bus wire B-1 inside the IDC. As indicated at block 514, when the switch is closed, the EDD and the next smart IDC in the sequence are energized.

FIG. 4C shows the logic diagram for the EDD. At 600, the EDD is powered on when the IDC is energized. At 602, in response to being energized, the EDD control circuit sends a "connector setting confirmed" signal to the blast machine confirming that SC-1 has been set and that EDD-1 now is "on line." At 604, the EDD control circuit waits for a command from the blast machine. At 606, in response to a command from the blast machine, the EDD is non-responsive to a "connector" command. If the command is other than a "detonator" or "connector" signal, the EDD responds according to the command to execute other functions at block 608.

If the command from the blast machine at 606 is a "detonator set" command, the EDD responds at block 610 depending on whether it is already marked as "set" or not. IF the EDD is already set, it ignores the command and waits for another command at 612 from the blast machine. If the EDD is not set, it accepts and stores the detonator data at 614 and replies to the blast machine at 616 reporting successful completion of the detonator setting function.

Once all detonators are logged and loaded with their respective detonator data, the blast machine is able to communicate with individual detonators to perform the blasting operation or other functions by addressing each detonator using the unique identity programmed into it during the logging operation.

In accordance with the present invention, a method is provided for logging a plurality of electronic delay detonators (EDD's) in a blast circuit in a blasting system. The blast system comprising a blast machine and first and second bus wires connected to the blast machine to form the blast circuit. A plurality of insulation displacement connectors (IDC'S) are interconnected in the blast circuit. Each of the plurality of electronic delay detonators (EDD's) is connected to the first and second bus wires by a different one of the plurality of IDC's. The plurality of EDD's is arranged in a serial blast pattern.

Once the EDD's and IDC's are interconnected in the prescribed blast pattern, only the first one of the plurality of IDC's is energized. After energizing the first one of the plurality of IDC's, the EDD connected to that first IDC is logged using a signal from the blast machine. The steps of first energizing the IDC and then logging the attached EDD is repeated one after another in the order they are assigned in the blast pattern until all EDD's are logged.

Now it will be appreciated that the present invention provides a system and method by which the process of logging detonators in a blast operation is made safer and more efficient. The inventive "smart" IDC's allow conventional electronic detonators to be logged remotely and automatically using only the blast machine. The logging of the detonators is carried out sequentially energizing and setting each detonator in the blast pattern in a domino fashion.

The embodiments shown and described above are exemplary. Many details are often found in the art and, therefore, many such details are neither shown nor described herein. It is not claimed that all of the details, parts, elements, or steps described and shown were invented herein. Even though numerous characteristics and advantages of the present invention have been shown in the drawings and described in the accompanying text, the description and drawings are illustrative only. Changes may be made in the details, especially in matters of shape, size, and arrangement of the parts, within the principles of the invention to the full extent indicated by the broad meaning of the terms of the attached claims. The description and drawings of the specific embodiments herein do not point out what an infringement of this patent would be, but instead provide an example of how to use and make the invention. Likewise, the abstract is neither intended to define the invention, which is measured by the claims, nor is it intended to be limiting as to the scope of the invention in any way. Rather, the limits of the invention and the bounds of the patent protection are measured by and defined in the following claims.

What is claimed is:

1. An insulation displacement connector (IDC) for a selected one of a plurality of electronic delay detonators (EDD's) in a blasting system comprising a blast machine, first and second bus wires connectable to the blast machine to form a blast circuit, and the plurality of EDD's, wherein each of the plurality of EDD's includes first and second leg wires, the IDC comprising:

a casing;

a control circuit;

first, second, and third connectors operably connected to the control circuit;

a switch for electrically connecting the first and third connectors, the switch being operatively connected to the control circuit;

a first barb set in the casing for electrically connecting the first bus wire with the first connector;

a second barb set in the casing for electrically connecting the second bus wire with the second connector;

a third barb set in the casing for electrically connecting the first bus wire to the third connector, the third barb set spaced a distance from the first barb set;

a fourth barb set in the casing for electrically connecting the second leg wire of the selected one of the plurality of EDD's with the second connector;

a fifth barb set in the casing for electrically connecting the first leg wire of the selected one of the plurality of EDD's with the third connector; and a wire cutter between the first and third barb sets for electrically severing the first bus wire; and wherein the control circuit is programmed, when the blast system is assembled and the blast circuit is energized, to receive "connector set" commands and "detonator set" commands from the blast machine via the first and second bus wires, to change the status of the IDC to "set" and to close the switch in response to a "connector set" command if the IDC is in a "not set" condition, to be nonresponsive to the "connector set" commands from the blast machine if the IDC is in a "set" condition, and to be nonresponsive to the "detonator set" commands, whereby each of the plurality of EDD's is logged sequentially.

2. The IDC of claim 1 wherein the wire cutter comprises two blades.

3. The IDC of claim 1 further comprising:

a first bus wire guide in the casing for receiving the first bus wire;

a second bus wire guide in the casing for receiving the second bus wire;

a first leg wire guide in the casing for receiving the first leg wire of the selected one of the plurality of EDD's; and a second leg wire guide in the casing for receiving the second leg wire of the selected one of the plurality of EDD's.

4. The IDC of claim 3 wherein each of the guides includes a groove, recess, snap ring, or cradle.

5. The IDC of claim 1 wherein the casing is waterproof.

6. The IDC of claim 1 wherein the casing is nonconductive.

7. The IDC of claim 1 wherein the casing further comprises a hinged or removable cover.

8. A blasting system comprising a blast machine, first and second bus wires connectable to the blast machine to form a blast circuit, and a plurality of electronic delay detonators (EDD's), and a plurality of insulation displacement connectors (IDC's) as defined in claim 1 including an IDC for each of the plurality of EDD's, wherein the blast machine is programmed, when the blast system is assembled and the blast circuit is energized, to send alternating "connector set" commands and "detonator set" commands to the plurality of IDC's via the first and second bus wires, whereby each of the plurality of EDD's is logged sequentially.

9. The blasting system of claim 8 wherein the each of the plurality of EDD's is programmed when energized by the IDC to send a signal to the blast machine confirming that the IDC has been set.

10. The IDC of claim 1 wherein the control circuit is furthered programmed, upon closure of the switch, to send a signal to the blast machine confirming that the IDC is in the set condition.

* * * * *